US005123858A

United States Patent [19]

Haag et al.

[11] Patent Number: 5,123,858

[45] Date of Patent: Jun. 23, 1992

[54] LOCKABLE ELECTRICAL CONNECTOR

[75] Inventors: Herbert Haag; Manfred Illg, both of Weinstadt; Hans Kieninger, Stuttgart, all of Fed. Rep. of Germany

[73] Assignee: ITT Industries, Inc., Secaucus, N.J.

[21] Appl. No.: 689,219

[22] Filed: Apr. 22, 1991

[30] Foreign Application Priority Data

Apr. 30, 1990 [DE] Fed. Rep. of Germany ..... 4013682

[51] Int. Cl.[5] ..... H01R 4/50

[52] U.S. Cl. ..... 439/347; 439/324

[58] Field of Search ..... 439/346, 347, 352, 353, 439/354, 373, 324, 709

[56] References Cited

U.S. PATENT DOCUMENTS 2,731,611 1/1956 Kamm ..... 439/347
2,866,958 12/1958 Postell ..... 439/709
4,367,003 1/1983 Frantz ..... 439/347
4,980,800 12/1990 Furuta ..... 439/347
4,995,826 2/1991 Schieferly ..... 439/347

*Primary Examiner*—Larry I. Schwartz
*Assistant Examiner*—Hien D. Vu
*Attorney, Agent, or Firm*—Thomas L. Peterson

[57] ABSTRACT

A lockable electrical connector is provided with two connector halves, and a locking device which includes at least one pin on one connector half and at least one receiving sleeve on the other connector half. The pin embodies an annular securing groove and the receiving sleeve is provided with a circumferentially extending slot. In the mated condition of the connector halves, a transversely displaceable slide extends through the slot in the sleeve into the securing groove in the pin to lock the connector halves together.

9 Claims, 5 Drawing Sheets 18
17
11
16
34
33
28
19
32
31
13
26
41
21
23
29
42
27

FIG. 2A
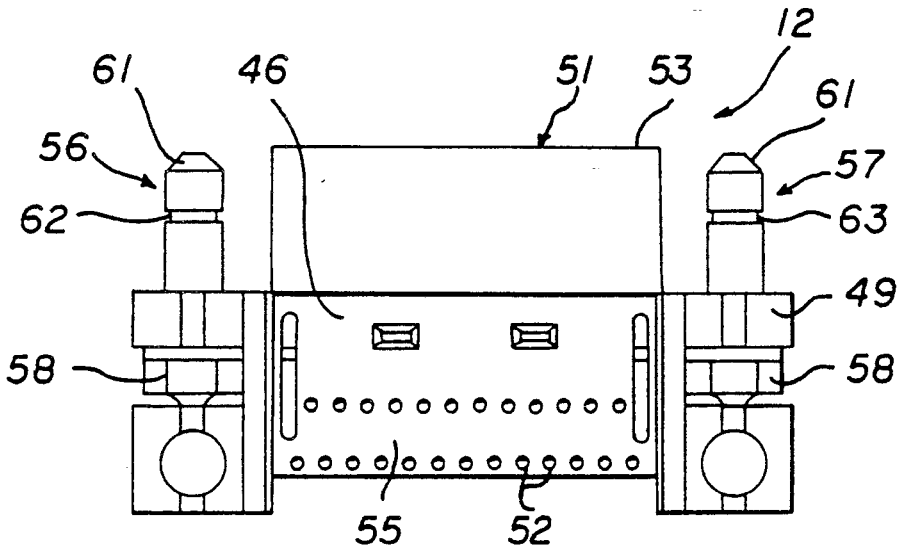
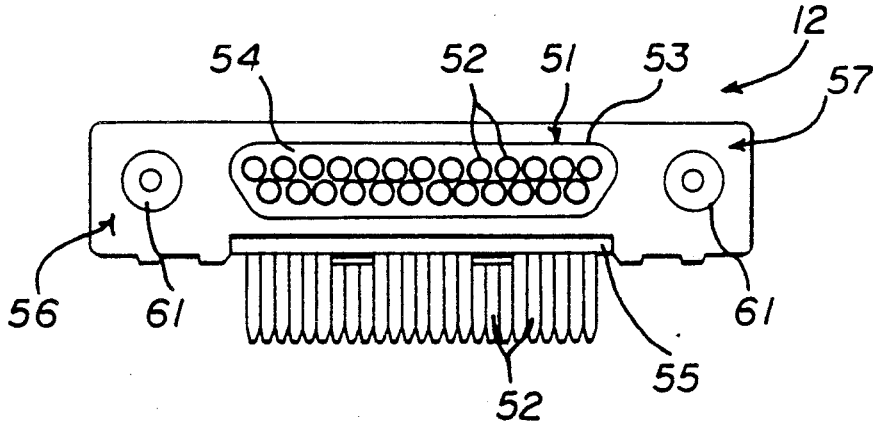
FIG. 2B

LOCKABLE ELECTRICAL CONNECTOR

BACKGROUND OF INVENTION

The present invention relates to a lockable electrical connector.

In a lockable electrical connector as produced at present, the locking device is created by having an internally threaded pin on the male connector half and a threaded bolt on the female connector half which is surrounded by a pin-receiving sleeve. The bolt is threaded into the internally-threaded pin. This enables the male and female connector halves to be reliably connected together after they have been plugged together.

With the ever-increasing reduction in the overall size of such lockable electrical connectors, the amount of space available for locking measures also becomes smaller and smaller, so that such locking systems by means of threaded parts become more impractical, especially as a tool generally has to be used in order to operate them. Particularly, also, in the case of connectors which are provided with an oblique cable exit on one side or both sides, the use of such a screwable locking device is extremely difficult, if not impossible.

It is, therefore, the purpose of the present invention to provide a reliable, rapid, and simple way of locking the connector halves together and unlocking them to separate them even in restricted and difficult handling conditions.

SUMMARY OF THE INVENTION

According to the present invention, there is provided a lockable electrical connector comprising mating male and female connector halves each containing a plurality of contacts. A locking device, which releasably locks the connector halves together, includes at least one pin on the male connector half and at least one sleeve on the female connector half, which slidably receives the pin when the connector halves are mated. The pin has a forward end and an annular retaining groove behind said forward end. A circumferentially extending slot is formed in the wall of the sleeve. A transversely displaceable slide on said female connector half has a locking section which extends through the locking slot into the pin groove to lock the connector halves together when they are fully mated. Preferably, the slide is spring-loaded to a locking position.

The invention enables the locking of the connector to be done quickly and in a simple manner, and also reliably. The connector can also be used in restricted and difficult handling conditions. Furthermore, practically no additional space of importance is required for mating and separating the connector. If the slide is spring-loaded, as in the preferred embodiment, the invention enables the locking to take place automatically when the two connector halves are plugged together, as the slide does not have to be actuated when the connector halves are coupled together. In this case, only for the purpose of separating the connector is it necessary to perform the unlocking operation—during which the two connector halves can then be pulled apart—by exerting pressure on one end of the slide.

As with the known lockable electrical connector, the male connector half of the connector of the present invention can be shaped and employed both as a printed circuit board connector and as a cable connector. In addition, the pin and the receiving sleeve serve a preliminary guidance function to protect the contacts, which can be plugged into each other, from damge. As compared with the known design, the connector of the present invention has the further advantage that the pin on the male connector half can be made in a more simple manner due to the elimination of the internal threads. Furthermore, the housing of the female connector half of the connector can be made in any desired shape, and can thus also be provided with an oblique cable exit of any desired nature.

BRIEF DESCRIPTION OF THE DRAWINGS

FIGS. 2A and 2B show a side view and a front end view, respectively, of the other connector half in the form of a male connector half of the lockable electrical connector according to the invention;

DESCRIPTION OF THE PREFERRED EMBODIMENTS

Figure 1:
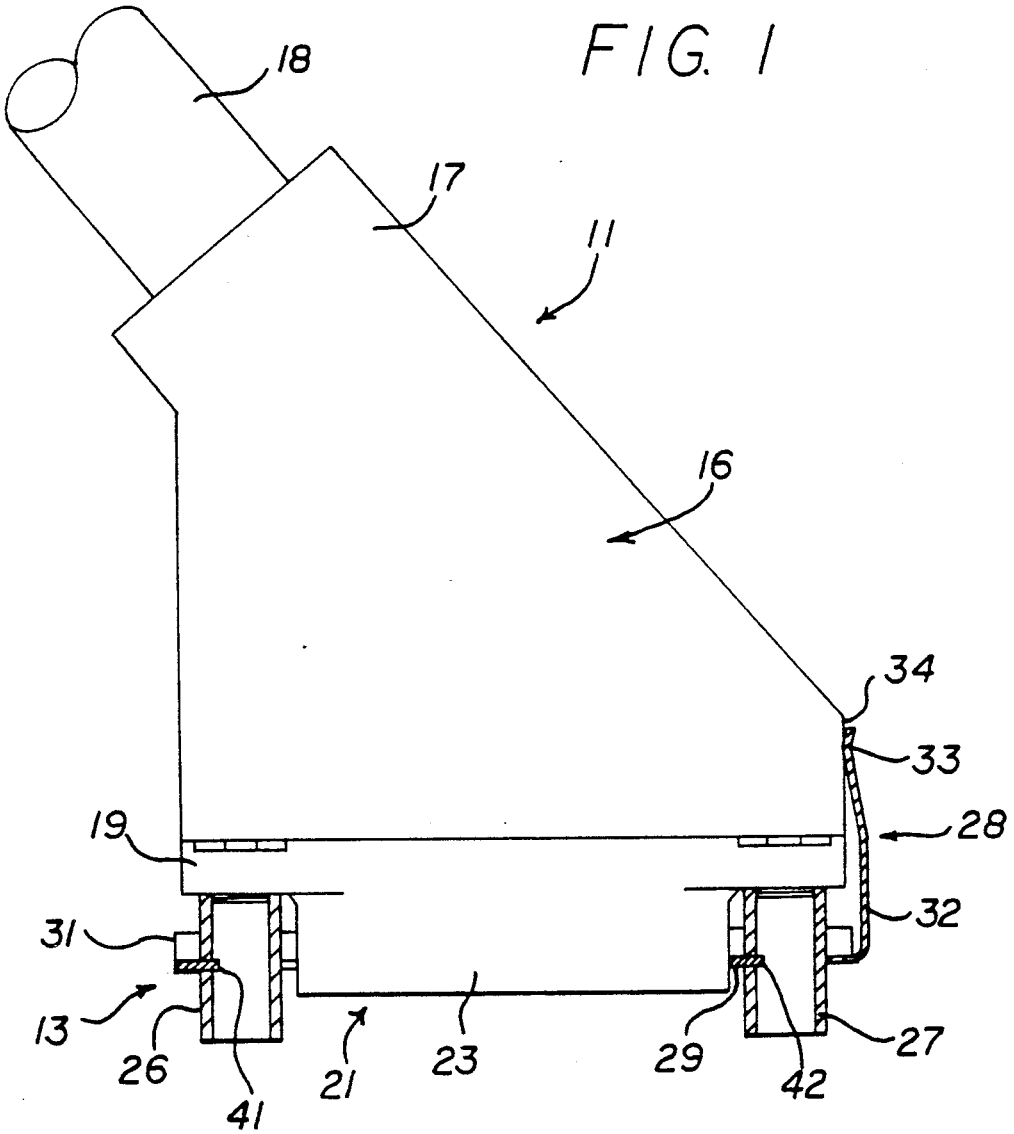
FIG. 1 shows, in a partial sectional side view, a connector half in the form of a female connector half of the lockable electrical connector according to a preferred embodiment of the present invention.
Figure 3:
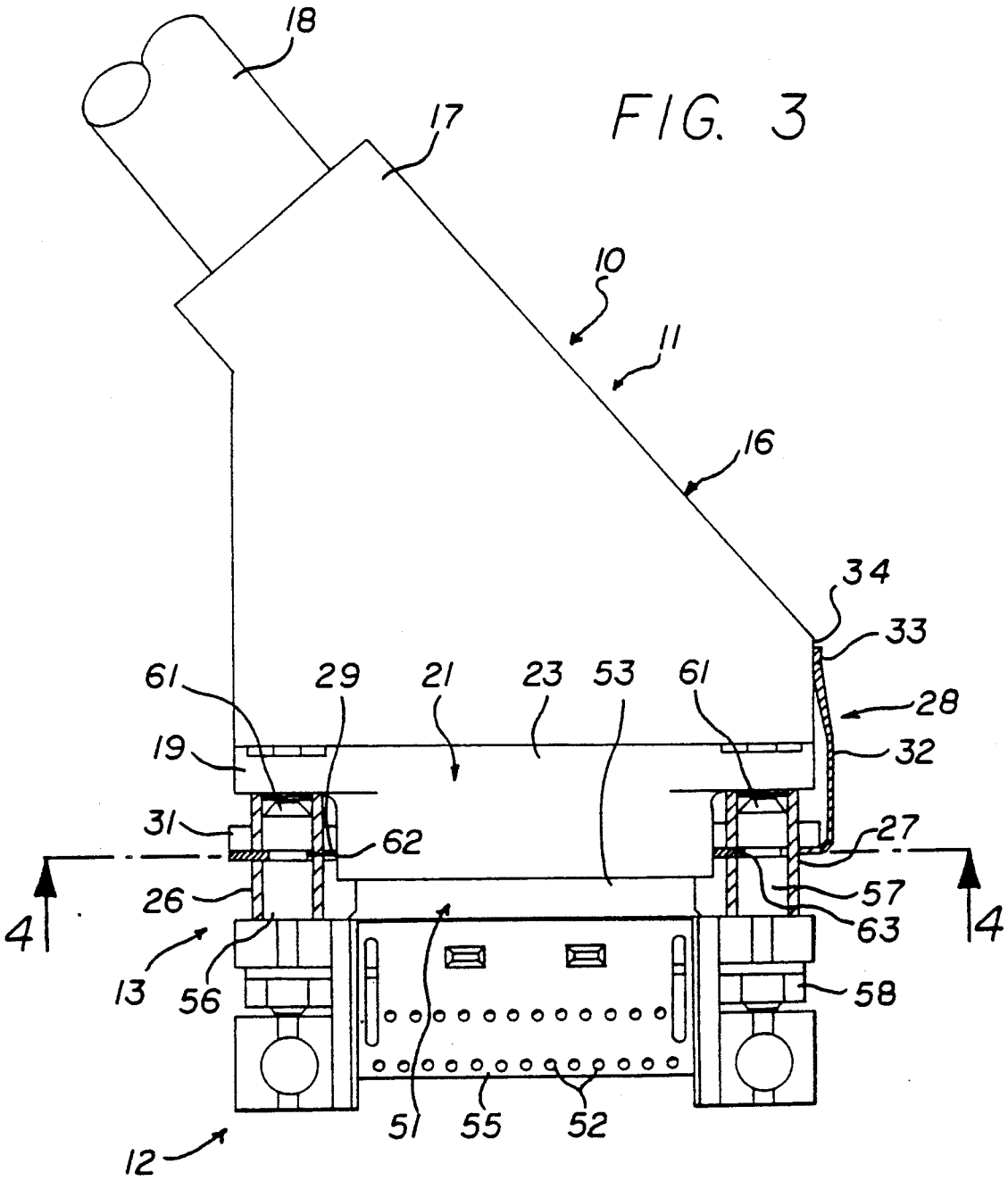
FIG. 3 shows, in a partial sectional side view, the lockable electrical connector according to the preferred embodiment of the invention with the connector halves locked together.

The lockable electrical connector 10, according to a preferred embodiment of the present invention, comprises two connector halves, namely, a female connector half 11 (FIG. 1) and a male connector half 12 (FIGS. 2A and 2B), which can be constructed either as a printed circuit board connector or a cable connector. The two connector halves 11 and 12 can be securely connected together by a rapid and simple locking device 13, which can also be handled in restricted and difficult space conditions.

The female connector half 11 has, as shown in FIG. 1, a housing 16 which is made of an insulating material, for example plastic, and whose end facing away from the connector plane is provided with an oblique exit 17 for a multi-conductor cable 18. The face side of the housing 16 is provided with a mounting plate 19, from which there projects in a central area a cross-sectionally, trapezoidal wall 23 of a contact device 21. Two rows of socket contacts 22 staggered in relation to each other are mounted in the contact device 21. The contacts 22 are disposed at an appropriate distance from each other and are insulated from each other in an insulative molded body 24 (FIG. 4A), which is mounted in the plate 19 in a manner not shown. In the embodiment shown, the wall 23 is of a plastic material, its inner edge being provided with a chamfer. It is also possible, however, to make the wall 23 of metal.

On both sides of the contact device 21, or its wall 23, there are arranged receiving sleeves 26 and 27 which are firmly connected to the mounting plate. The sleeves extend parallel to the contact device 21. The front of the receiving sleeves 26, 27 project forwardly of the front side of the wall 23. The front of the sleeves could, however, be recessed instead, especially if the wall 23 were made of metal.

The locking device 13 comprises a locking spring 28 mounted on the female connector half 11. The spring embodies a slide 29, which is shaped like a plate with longitudinal side edges 31 bent toward the housing 16. The slide is integrally connected at one end with a spring arm 32 bent toward the housing 16. The spring arm 32 lies with its free end area 33 bearing against a side surface 34 of the housing 16 of the female connector half 11 in a prestressed condition. The plate area of the slide 29 of the locking spring 28 has a longer and a shorter longitudinal slot 36 and 37, respectively. Passing through the longer longitudinal slot 36 is the wall 23 of the contact device 21 and the one receiving sleeve 26, while the other receiving sleeve 27 passes through the shorter longitudinal slot 37. The longitudinal slots 36 and 37 are defined by a strut 38 immediately adjacent to the spring arm 32, by an intermediate strut 39, and by an end strut 40 arranged at the end remote from the spring arm 32.

The intermediate strut 39 and the end strut 40 extend into locking slots 41 and 42, respectively, made along a partial circumferential area of the receiving sleeves 26 and 27, respectively. The internal edges 43 and 44 of the struts 39 and 40, which penetrate into the locking slots 41 and 42, are shaped in the manner of an arc.

In the rest, or unstressed, position of the locking spring 28 shown FIG. 1, the slide 29 is held by the spring arm 32 in such a way that the inner edges 43 and 44 of the struts 39, 40 extend into the receiving sleeves 26 and 27 and lie laterally against the bottom of the slots 41 and 42.

A shown in FIGS. 2A and 2B, the male connector half 12, which is made as a printed circuit board connector in the embodiment shown, comprises a plate-like housing 46, which is connected on one side with a mounting plate 49. The mounting plate projects perpendicularly, and is securely connected to a wall 53 of a contact device 51. Inside the trapezoidal wall 53 of the contact device there is disposed a molded body 54 of insulating material in which two rows of contact pins 52 are received. The contact pins emerge from the rear of the housing 46. The contact pins are L-shaped and are held in a perpendicularly projecting rear wall 55. The trapezoidal wall 53 and the contact pins 52 of the male connector half 12 are shaped in such a way that they fit into the corresponding parts 23 and 22 of the female connector half 11. If the wall 53 is made of a plastic material, as is the case in the embodiment shown, it is integral with the molded body 54. It is also possible to make the wall 53 of metal.

Projecting from the mounting plate 49 parallel to the contact device 51 are two pins 56 and 57. The pins extend through holes in the mounting plate 49. The rear the embodiment shown, comprises a plate-like hosuing 46. ends of the pins extending below the plate 49, as viewed in FIG. 2A, are threaded. Nuts 58 on such threaded ends serve to hold a device or the like (not shown) to a wall of the connector housing. Each pin 56 and 57 is provided at its free forward end with an insertion bevel in the form of a cone 61. Retaining grooves 62 and 63, respectively, run round the entire circumference of the pins 56 and 57 behind the forward ends of the pins.

The pins 56 and 57 of the male connector half 12 are constructed in such a way that they are slidably insertable without any appreciable play into the receiving sleeves 26 and 27 of the female connector half 11. In the inserted state of the pins in the sleeves, the retaining grooves 62 and 63 are disposed in the plane of the locking slots 41 and 42 of the receiving sleeves 26 and 27. Thereby, in the locked condition of the connector, the inner edges 43 and 44 of the struts 39 and 40 of the slide 29 engage in the retaining grooves 62 and 63 in order to lock them together. As shown in FIG. 2A, the forward ends of the pins 56 and 57 are almost in the plane of the front of the wall 53. Such forward ends may instead, especially when there is a metal wall 53, project beyond the contact device 51 or the front of the wall 53, in order that the pins 56 and 57 in conjunction with the receiving sleeves 26 and 27 shall form a preceding guiding device in which the pins and the receiving sleeves engage each other before the two contact devices 21 and 51 become joined.

The locking device 13 is thus formed by the pins 56, 57 and the receiving sleeves 26, 27, which can be plugged into each other and which at the same time can form a preliminary guide, and by the spring-loaded locking device 13.

Figure 4A:
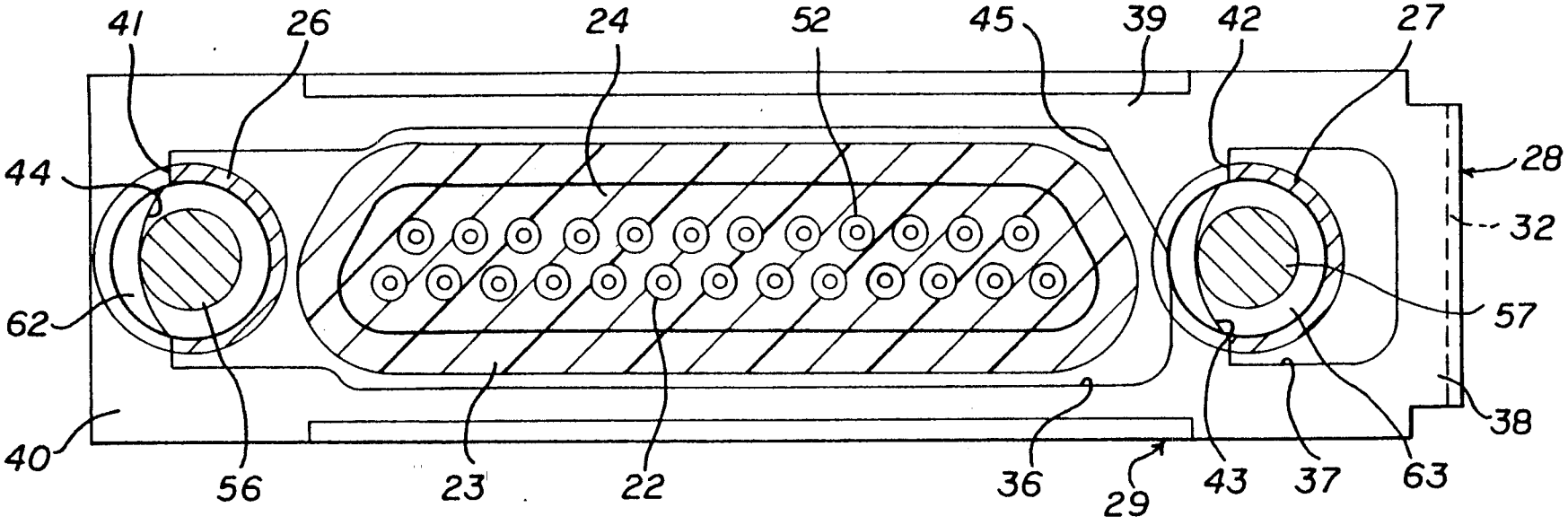
FIGS. 4A and 4B are sectional views taken along line 4—4 of FIG. 3, showing the locked and unlocked positions of the locking device of the connector, respectively.
Figure 4B:
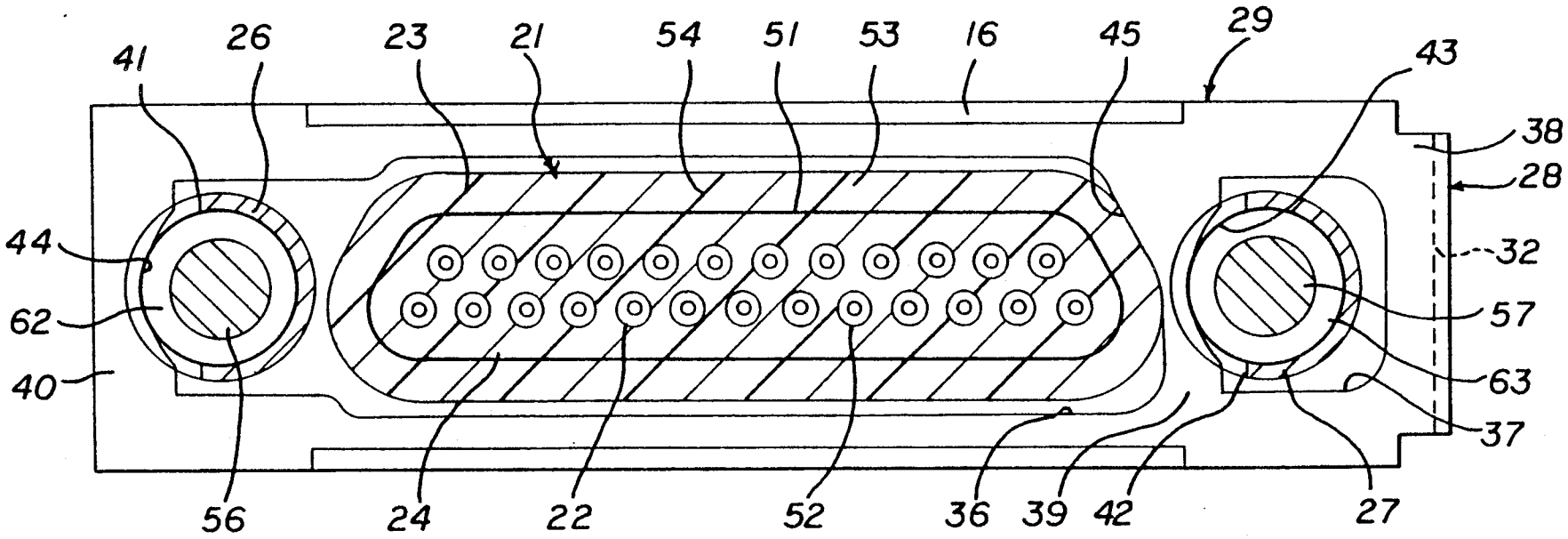

The way in which the two connector halves 11 and 12 are locked when they are plugged together is that, with the insertion of the male connector half 12 into the female connector half 11, the cones 61 of the pins 56 and 57 penetrate into the receiving sleeves 26 and 27 pushing back the slide 29 engaging in the locking slots 41 and 42 of the receiving sleeves 26 and 27 against the operation of the spring arm 32. The male connector half 12 can then be inserted as far as the stop (not shown) into the female connector half 11 to fully mate the connector halves. In this final position, the retaining grooves 62 and 63 of the pins 56, 57 reach the plane of the locking slots 41 and 42 of the receiving sleeves 26, 27, so that the slide 29 returns to its rest position through the operation of the stressed spring 32 and is thus automatically brought into its locking position. In this locking position, the inner edges 43 and 44 of the struts 39 and 40 lie, as shown in FIG. 4A, against the bottoms of the retaining grooves 62 and 63 of the pins 56 and 57.

The unlocking to enable the female connector 11 and the male connector 12 to be drawn apart takes place by applying lateral pressure on the spring arm 32, so that the struts 39 and 40 released from the retaining grooves 62 and 63 of the pins 56, 57. For this, an edge 45 of the intermediate strut 39, which faces the wall 23 of the contact device 21, has a shape that generally conforms to the external shape of the wall 23. The edge 45 is at such a distance from the opposite edge 43 of the intermediate strut 39 that it abuts against the wall 23 to limit the unlocking movement of the slide 29 when the two edges 43 and 44 emerge from the internal space of the receiving sleeves 26 and 27, that is, release from the retaining grooves 62 and 63 of the pins 56 and 57, but are nevertheless still disposed within the locking slots 41 and 42. Thereby the slide 29 is held in its plane aligned with the slots 41 and 42. Lateral movement of the locking spring 28 is prevented by the bent back, longitudinal edges 31 of the slide and by the receiving sleeves 26 and 27 and the wall 23.

If automatic locking is not necessary, the bent back spring arm 32 of the slide 29 could be eliminated, but this would require manual actuation of the slide to both lock and release the locking device 13.

What is claimed is:

1. A lockable electrical connector comprising:

mating first and second connector halves each containing a plurality of contacts;

locking means for releasably locking said connector halves together;

said locking means comprising at least one pin on one said connector half and at least one sleeve on the other connector half, said sleeve slidably receiving said pin when said connector halves are mated;

said pin having a forward end and a retaining groove behind said forward end;

a circumferentially extending locking slot extending through the wall of said sleeve; and hand accessible slide means disposed on said other connector half and selectively linearly displaceable on said other connector half along a predetermined linear direction between a nonlocking and locking position, said slide means having a locking section extending through said slot into said groove when said connector halves are fully mated and when said slide means is linearly displaced into said locking position.

2. A lockable electrical connector as set forth in claim 1 wherein:

said forward end of said pin is formed with a bevel for facilitating insertion of said pin into said sleeve.

3. A lockable electrical connector as set forth in claim 1 including:

spring means biasing said slide in a direction in which said slide means extends through said slot into said groove.

4. A lockable electrical connector comprising:

mating first and second connector halves each containing a plurality of contacts;

locking means for releasably locking said connector halves together;

said locking means comprising at least one pin on said connector half and at least one sleeve on the other connector half, said sleeve slidably receiving said pin when said connector halves are mated;

said pin having a forward end and a retaining groove behind said forward end;

a circumferentially extending locking slot extending through the wall of said sleeve;

transversely displaceable slide means on said other connector half having a locking section extending through said slot into said groove when said connector halves are fully mated;

spring means biasing said slide in a direction in which said slide means extends through said slot into said groove;

wherein:

said other connector half includes a housing having a side wall;

said slide is formed of metal; and said spring means comprises a bent back end of said metal slide bearing against said side wall in a pre-stressed condition to normally extend said locking section through said slot.

5. A lockable electrical connector as set forth in claim 1 wherein:

said slide means contains a first slot through which said sleeve extends.

6. A lockable electrical connector comprising:

mating first and second connector halves each containing a plurality of contacts;

locking means for realeasably locking said connector halves together;

said locking means comprising at least one pin on one said connector half and at least one sleeve on the other connector half, said sleeve slidably receiving said pin when said connector halves are mated;

said pin having a forward end and a retaining groove behind said forward end;

a circumferentially extending locking slot extending through the wall of said sleeve;

transversely displaceable slide means on said other connector half having a locking section extending through said slot into said groove when said connector halves are fully mated;

wherein:

said slide means contains a first slot through which said sleeve extends;

said other connector half embodies a forwardly extending contact device containing one of said plurality of contacts; and said slide means contains a second slot through which said contact device extends, said second slot being sufficiently long to permit said slide means to shift lengthwise relative to said contact device from a first position wherein said locking section extends through said sleeve slot into said groove, to a second position in which said locking section lies outside of said groove.

7. A lockable electrical connector comprising:

mating first and second connector halves each containing a plurality of contacts;

locking means for releasably locking said connector halves together;

said locking means comprising at least one pin on one said connector half and at least one sleeve on the other connector half, said sleeve slidably receiving said pin when said connector halves are mated;

said pin having a forward end and a retaining groove behind said forward end;

a circumferentially extending locking slot extending through the wall of said sleeve;

transversely displaceable slide means on said other connector half having a locking section extending through said slot into said groove when said connector halves are fully mated;

wherein:

said slide means contains first and second slots separated by a strut, the edge of said strut bordering said first slot forming said locking section;

said sleeve extends through said first slot with said locking slot facing said strut; and said other connector half embodies a forwardly extending contact device containing one of said plurality of contacts, said contact device extending through said second slot.

8. A lockable electrical connector as set forth in claim 7 wherein:

said strut has a width such that when said slide means is in a locking position said edge of said strut embodying said locking section extends through said locking slot into said groove and the opposite edge of said strut is spaced from said contact device and, when said slide means is in an unlocked position, said edge of said strut embodying said locking section is outside of said groove and said opposite edge of said strut abuts said contact device.

9. A lockable electrical connector comprising:

mating male and female connector halves, each having a forwardly extending contact device containing a plurality of contacts;

locking means for releasably locking said connector halves together;

said locking means comprising receiving sleeves on said female connector half on both sides of said female connector contact device, and corresponding pins on said male connector contact device adapted to slide into said sleeves when said connector halves are mated;

slide means disposed on said female connector half and transversely displaceable relative to said sleeves along a path of movement, said slide means containing first and second slots aligned in said path of movement, one of said sleeves extending through said first slot, and said female connector half contact device and the other sleeve extending through said second slot;

a circumferentially extending locking slot extending through the wall of each said sleeve aligned with said slide means, said locking slots facing in the same direction;

each said pin having an annular groove therein aligned with said slide means when said pin slides into its corresponding sleeve when said connector halves are mated;

in a locking position of said slide means, first edges of said slide means adjacent to said first and second slots facing in a direction opposite to said first-mentioned direction extending through said locking slots into said pin grooves when said connector halves are fully mated; and in an unlocked position of said slide means, another edge of said slide means adjacent to said second slot facing in said first direction abutting against said female connector half contact device while said first edges are still disposed in said locking slots without projecting into said grooves, whereby said connector halves may be unmated.

* * * * *